US007926496B2

(12) United States Patent
Young et al.

(10) Patent No.: US 7,926,496 B2
(45) **Date of Patent: *Apr. 19, 2011**

(54) APPARATUS AND METHOD FOR HOLDING AND TILTING AN UMBRELLA

(75) Inventors: David Young, St. Charles, IL (US); Robert G. Tegel, Huntley, IL (US); Richard Bauer, Palatine, IL (US)

(73) Assignee: Resort Umbrella Solutions, LLC, St. Charles, IL (US)

( * ) Notice: Subject to any disclaimer, the term of this patent is extended or adjusted under 35 U.S.C. 154(b) by 67 days.

This patent is subject to a terminal disclaimer.

(21) Appl. No.: 12/476,098

(22) Filed: Jun. 1, 2009

(65) Prior Publication Data

US 2009/0314319 A1 Dec. 24, 2009

Related U.S. Application Data

(60) Provisional application No. 61/057,693, filed on May 30, 2008.

(51) Int. Cl.
*A45B 17/00* (2006.01)
*A47B 37/04* (2006.01)

(52) U.S. Cl. ..... 135/16; 135/20.1; 135/20.3; 108/50.12; 248/515; 248/538

(58) Field of Classification Search ..... 135/96, 135/98, 15.1, 16, 20.1, 20.3, 155; 108/50.11–50.13; 248/514–515, 534–538, 292.11–292.12; 116/173

See application file for complete search history.

(56) References Cited

U.S. PATENT DOCUMENTS

| | | | | | |
|---|---|---|---|---|---|
| 1,020,846 | A | * | 3/1912 | Rauch | 248/514 |
| 2,782,085 | A | * | 2/1957 | Natale | 108/94 |
| 3,182,673 | A | * | 5/1965 | Small | 135/20.3 |
| 3,311,119 | A | * | 3/1967 | Pearlstine | 135/20.3 |
| 3,434,484 | A | | 3/1969 | Dilullo | |
| 3,744,503 | A | | 7/1973 | Wolff et al. | |
| 3,765,434 | A | | 10/1973 | Riggs | |
| 3,850,186 | A | | 11/1974 | Weber et al. | |
| 4,132,236 | A | * | 1/1979 | Petersen et al. | 135/16 |
| 4,347,834 | A | | 9/1982 | York | |
| 4,546,756 | A | | 10/1985 | Leroy et al. | |
| 4,582,078 | A | * | 4/1986 | Ma | 135/20.3 |
| 5,029,596 | A | | 7/1991 | Tung | |
| 5,046,699 | A | | 9/1991 | Perreault et al. | |
| 5,086,797 | A | | 2/1992 | Earnshaw et al. | |

(Continued)

OTHER PUBLICATIONS

Office Action mailed Feb. 12, 2008 for U.S. Appl. No. 11/282,411, filed Nov. 17, 2005.

(Continued)

*Primary Examiner* — Winnie Yip

(74) *Attorney, Agent, or Firm* — McAndrews, Held & Malloy, Ltd.

(57) ABSTRACT

Apparatus and methods are provided for holding and tilting an umbrella. The apparatus comprises at least one spring connected to an umbrella pole so that operation of the spring (s) moves the umbrella pole so as to adjust the pole angle of the umbrella. The apparatus also comprises a pivot for the umbrella pole that allows angular motion of the umbrella pole. The apparatus also comprises a rotary bearing capable of rotating around an axis of the umbrella pole. The spring(s) and the pivot can be connected to the rotary bearing. The present apparatus can also include a shade umbrella and an outdoor table. Methods for tilting an umbrella are also provided.

18 Claims, 6 Drawing Sheets

U.S. PATENT DOCUMENTS

| | | | | |
|---|---|---|---|---|
| 5,110,184 | A | 5/1992 | Stein et al. | |
| 5,344,115 | A | 9/1994 | Mayne et al. | |
| 5,360,163 | A * | 11/1994 | Dupre | 239/14.2 |
| 5,441,066 | A | 8/1995 | Harris | |
| 5,478,041 | A | 12/1995 | Mayne | |
| 5,836,327 | A | 11/1998 | Davis | |
| 5,944,384 | A | 8/1999 | Patterson | |
| 6,029,595 | A | 2/2000 | Bachmann | |
| 6,058,951 | A | 5/2000 | Wilson | |
| 6,234,187 | B1 | 5/2001 | Izzo | |
| 6,286,530 | B1 | 9/2001 | Hussey | |
| 6,311,705 | B1 | 11/2001 | Ma | |
| 6,330,886 | B1 | 12/2001 | Culver | |
| 6,364,562 | B1 | 4/2002 | Tung | |
| 6,401,736 | B1 | 6/2002 | Jerry | |
| 6,446,649 | B1 | 9/2002 | Bigford | |
| 6,463,946 | B1 * | 10/2002 | Wu | 135/16 |
| 6,516,820 | B1 | 2/2003 | Earnshaw | |
| 6,575,182 | B2 * | 6/2003 | Tung | 135/20.1 |
| 6,604,844 | B2 | 8/2003 | Hussey | |
| 6,810,892 | B2 * | 11/2004 | Lai | 135/20.3 |
| 7,128,076 | B2 | 10/2006 | Freedman | |
| 7,188,633 | B2 | 3/2007 | Zerillo | |
| 7,207,343 | B2 * | 4/2007 | Earnshaw et al. | 135/20.1 |
| 7,363,930 | B2 | 4/2008 | Vanderminden | |
| 7,412,985 | B2 * | 8/2008 | Ma | 135/20.3 |
| 7,503,336 | B2 | 3/2009 | Labarbera | |
| 7,631,653 | B2 * | 12/2009 | Young et al. | 135/15.1 |
| 2004/0055627 | A1 | 3/2004 | Moga | |
| 2004/0069922 | A1 | 4/2004 | Wu | |
| 2004/0134526 | A1 | 7/2004 | Freedman | |
| 2006/0272555 | A1 | 12/2006 | Carter | |
| 2006/0278262 | A1 | 12/2006 | Ma | |

OTHER PUBLICATIONS

Office Action mailed May 30, 2008 for U.S. Appl. No. 11/282,411, filed Nov. 17, 2005.

Office Action mailed Jan. 6, 2009 for U.S. Appl. No. 11/282,411, filed Nov. 17, 2005.

Office Action mailed Jun. 15, 2009 for U.S. Appl. No. 11/282,411, filed Nov. 17, 2005.

Lucid Gas Springs, http://www.gas-spring.biz/gas_sping.htm, Copyright © 2000-2008 Lucid Int'l.

Lucid Gas Springs, http://www.gas-spring.biz/lock_type.htm, Copyright © 2000-2008 Lucid Int'l.

* cited by examiner 76
66
72
70
48
64
68
62
74

APPARATUS AND METHOD FOR HOLDING AND TILTING AN UMBRELLA

CROSS-REFERENCE TO RELATED APPLICATIONS

The present application claims the priority of U.S. Provisional Application No. 61/057,693, filed May 30, 2008, which is incorporated by reference herein.

FIELD OF THE INVENTION

The present disclosure relates to apparatus and methods for holding and tilting an umbrella. The present disclosure provides an apparatus which allows a user to easily adjust the angle and/or position of an umbrella to provide increased or decreased shade as desired by the user.

BACKGROUND

Shade umbrellas are frequently used to provide shade outdoors, such as over or around outdoor tables. Shade umbrellas typically include an umbrella pole and a canopy made of fabric or other pliable material attached to an upper end of the umbrella pole. The umbrellas typically include lateral supports such as ribs that are spaced around the canopy. These supports can be raised or lowered in order to open or close the canopy. Often shade umbrellas are placed to provide shade over an outdoor table by inserting a bottom end of the umbrella pole into a base that rests on the ground, below the table. The umbrella pole extends through a hole in the table, so that the canopy is above the table.

Shade umbrellas have been provided with a joint as part of the umbrella pole, so that the canopy can be tilted. For example, many shade umbrellas have a joint that can be locked or released, which is disposed on the upper ⅓ of umbrella pole length whereas it is close proximity to the canopy. The joint is disposed so that an upper portion of the umbrella pole, along with the canopy, can be tilted while approximately ⅔ of the lower portion of the umbrella pole remains perpendicular. When the joint is released, the angle of the canopy and upper portion can be changed and when the joint is locked it holds the canopy at the desired angle, typically to one of three positions.

BRIEF SUMMARY OF THE INVENTION

Novel apparatus and methods are provided for holding, tilting and balancing an umbrella having a pole and a canopy. The umbrella pole and a surface such as a table top or the ground define a pole angle, and the present apparatus and methods relate to adjusting the pole angle of the umbrella in a new and improved manner. The present apparatus and methods are particularly useful with outdoor tables especially early and late in the summer seasons when the angle of the sun is lower, in that the angle of the umbrella can be easily adjusted to provide the desired amount and area of shade for individuals sitting under the canopy. In some embodiments, a pivot is provided at a lower position than in conventional umbrellas, which often have a pivot or joint within the pole relatively high and close to the canopy. A pivot can be provided at or near the table top or other surface. For example, the pivot can be provided within a hole in a table top or other surface or in a housing that rests on such a surface. The feature of a substantially lower pivot provides further benefits such as increasing privacy and framing one's view.

As one aspect of the present invention, an apparatus is described for holding and tilting a shade umbrella having an umbrella pole and a canopy. The apparatus comprises at least one spring connected (directly or indirectly) to the umbrella pole so that operation of the spring(s) moves the umbrella pole from a first position to a second position. The umbrella pole is maintained in the second position, such as by a lock or fastener that is part of the spring(s) or connected to the spring (s). The umbrella pole defines a pole angle with a surface below the canopy, and the umbrella pole has a different pole angle when it is in the second position compared to the first position. The apparatus also comprises a pivot for the umbrella pole that allows angular motion of the umbrella pole. The apparatus also comprises a rotary bearing capable of rotating around an axis of the umbrella pole. The spring(s) and the pivot can be connected (directly or indirectly) to the rotary bearing.

As another aspect of the present invention, an apparatus is described for holding and tilting a shade umbrella that provides shade over an outdoor table or other outdoor area. The shade umbrella comprises an umbrella pole and a canopy at a top end of the umbrella pole, and the outdoor table has a table top having a hole for receiving the umbrella pole and one or more legs for supporting the table top. The apparatus comprises at least one spring connected to the umbrella pole so that the umbrella pole moves when the spring(s) extends or retracts. The apparatus also comprises a pivot that engages the umbrella pole at or near the table top. The umbrella pole pivots when an end of the umbrella pole moves, and this changes a pole angle formed by the umbrella pole and a surface, such as the table top or ground. The pivot and the spring(s) can be connected (directly or indirectly) to the table.

As another aspect of the present invention, an apparatus is described for holding and tilting a shade umbrella which comprises a holder for receiving an umbrella pole and a latch at an end of the holder opposite from the umbrella. The apparatus also includes a rotary bearing capable of rotating around an axis of the umbrella pole. A bracket extends down from the rotary bearing, and the latch engages the bracket to maintain the holder at a desired pole angle. The holder can have an open tube at a first end for receiving an umbrella pole, and one or more arms at a second end for engaging the bracket. A handle can be provided on the holder and connected to the latch, so that operation of the handle releases or engages the latch. On operation of the handle, the latch releases, and the holder can be adjusted so as to change the pole angle of the umbrella pole. The present apparatus can also include at least one spring connected (directly or indirectly) to the holder and the bracket, such as a gas spring attached to the holder arm and to the bracket. The spring(s) has at least first and second positions, wherein the umbrella pole has a different pole angle when in the second position compared to the first position. The engagement of the latch and the bracket maintains the umbrella pole at a selected pole angle.

As yet another aspect of the present invention, a method of tilting a shade umbrella is described. The shade umbrella comprises an umbrella pole and a canopy, and the method comprises moving the umbrella from a first pole angle to a second pole angle. The method also comprises rotating the umbrella around an axis of the umbrella pole, typically the vertical axis defined when the umbrella is perpendicular to a surface such as a table top or ground. The umbrella can be moved from a first pole angle to a second pole angle by changing the pole angle of the entire umbrella pole and/or by moving a bottom portion of the umbrella pole. Preferably the umbrella is moved from a first pole angle to a second pole angle by the user grasping the pole and either pulling the pole toward the user or pushing the pole away from the user. The user can change the pole angle using only one hand. The present methods can also include disengaging a latch or lock that maintains the pole angle before changing the pole angle, and/or engaging the latch or lock after changing the pole angle. Preferably the latch or lock can be engaged or disengaged by pushing a handle up or down, or by locking or unlocking a gas spring. As another aspect, an apparatus is described that comprises one or more means for performing the moving and/or rotating steps.

In various embodiments of the foregoing aspects, the present apparatus and methods can comprise or be used with a table having a top and one or more legs, or with another outdoor surface. In preferred embodiments, the present apparatus includes a rotary bearing that is attached to a table top or other surface, or to a housing on a surface. Spring(s) are connected to the rotary bearing, with gas spring(s) being particularly preferred.

The present apparatus can include components that provide for automated movement of the umbrella. For example, the apparatus can also include a linear actuator, and/or a motor, and/or a timer, and/or a sun-tracking means, operatively connected to the umbrella pole, to the spring(s) and/or to the rotary bearing. For example, a linear actuator can be operatively connected to the spring(s) so that the spring(s) are automatedly extended or retracted. As another example, a motor can be operatively connected to the rotary bearing so that the rotatable portion of the rotary bearing is automatedly rotated. The apparatus can also include a controller operatively connected to the spring(s) and/or the rotary bearing for moving the umbrella whereby movement of the umbrella is manually or automatically actuated.

As another aspect of the invention, an apparatus is disclosed for providing protection from sun or other weather conditions. The apparatus includes an umbrella in combination with one of the apparatus for holding and tilting an umbrella described herein.

DETAILED DESCRIPTION OF THE INVENTION

Figure 1:
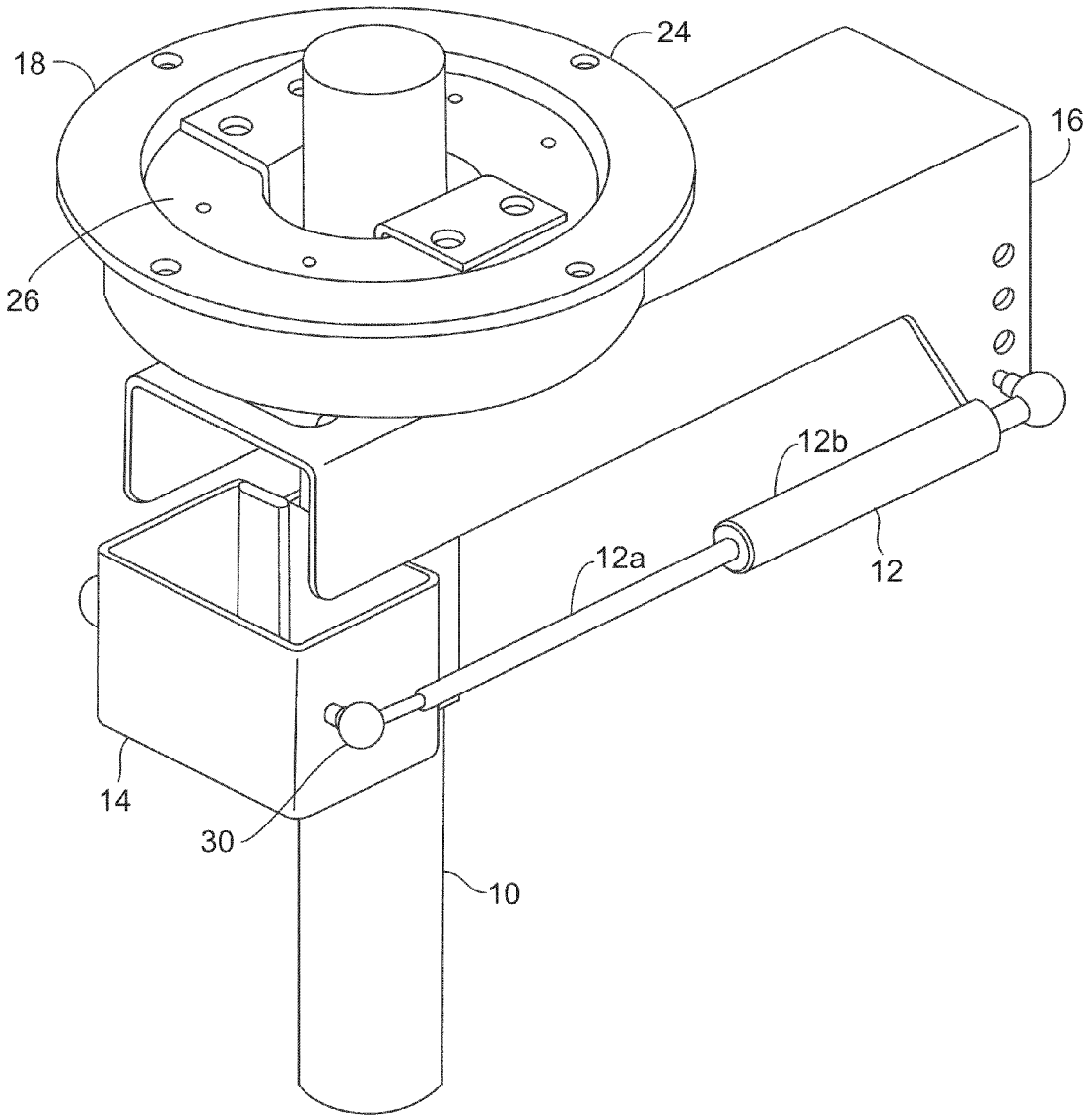
FIG. 1 shows an apparatus for holding and tilting an umbrella.

The present disclosure provides an umbrella apparatus which allows a user to easily adjust the umbrella, such as by adjusting the angle of the umbrella pole or the rotational position of the canopy. The apparatus is especially suited for outdoor tables, but also may be used with any outdoor surface, such as a bar, a sales counter, or other surface. The apparatus may be used at sporting events, cafes, pools, picnics, backyards, or any other location where protection from the sun or other elements is desirable. In some embodiments, the user can move and/or rotate the umbrella by hand, such as by grasping the umbrella pole and pushing or pulling it. Alternatively the user can use a controller to adjust the umbrella where the apparatus is configured for automated operation. In other embodiments, the umbrella is automatically adjusted based upon the time and/or the sun's position. Automated movement of the umbrella can be actuated by means of a timer or a sun-tracking device.

Various embodiments of the present apparatus can provide one or more advantages over the prior art, including but not limited to: easy adjusting of a shade umbrella's angle or position; lack of joints between two portions of the umbrella pole, which may be difficult to press or actuate; relatively few and simple moving parts; and/or automated movement of the umbrella. Preferably in the present apparatus, the umbrella pole does not include a joint in the umbrella pole, such as one that allows one portion of the umbrella pole to be angled while another portion remains vertical. The present apparatus also need not include a base that rests on the ground, though it is also contemplated that a base may be desirable. Where other apparatus may use disproportionately heavy or bulky weights or mass to stabilize an umbrella system, the present apparatus is different in that the weight or mass and the bulk are reduced by using one or more springs. The reduction in weight/mass yields an apparatus that has a lower shipping weight, lower shipping volume, enhanced portability, and allows interaction with a user in a more natural and positive manner. The spring(s) can introduce a dampening characteristic so the umbrella will move in a more fluid motion through its range of travel.

In some embodiments, the present apparatus include one or more springs. Examples of suitable springs include gas springs; coil wound springs; machined springs; pneumatic springs; hydraulic springs; torsion springs; compression/extension springs; lateral bending springs; lateral translation springs; and others. Preferably one or more of the springs is a gas spring. Suitable gas springs may be obtained commercially from Lucid Gas Springs of Los Alamitos, Calif.; Suspa Inc. of Grand Rapids, Mich.; and Easylift of North America Inc., of Melbourne, Fla. A gas spring is typically filled with air, but may hold any suitable fluid, including air, water, oil, and others.

The present apparatus can comprise one or more locks for maintaining extension or retraction of the spring(s). Preferred gas springs are self-locking, in that they lock in place after being extended. The gas spring is released, thereby allowing retraction, by pressing a release button or valve. Other springs may be locked in extended or retracted position by fasteners, catches, or other devices that may be integral with or associated with the springs.

The present apparatus can include a rotary bearing. A rotary bearing may be any device or means that permits relative motion between two parts where one of the parts rotates, typically around a central axis and optionally without movement of the other part. Generally the rotary bearing operates primarily on a vertical axis and is adapted for providing circular motion, though the rotary bearing may be adapted for providing an elliptical motion. Any suitable rotary bearing may be used in the present apparatus, including rotary bearings that employ rolling bearings such as ball bearings and roller bearings, fluid bearings in which the load is carried by a gas or liquid, magnetic bearings, sliding bearings, or flexure bearings.

Preferably the rotary bearing permits rotation of the umbrella pole with a suitable amount of friction, so that the umbrella can be rotated by hand with relative ease but does not spin too freely. Grease or another lubricant can be used to reduce friction in the rotary bearing, or in any pivots or other moving parts of the present apparatus, though some friction may be desirable. Where the spring(s) and umbrella pole are connected to the rotary bearing, the umbrella can be rotated when upright or when at a desired pole angle. The combination of angular and rotational motion permits a user to put the canopy of the umbrella in a position desired. Alternatively, the apparatus can include a lock, pin, magnets, or fastener adapted to prevent rotation of the rotary bearing when the lock, pin or fastener is used. For example, the apparatus can include a pin disposed on a table or other stationary portion of the apparatus, so that the pin will fall and lock into one or more holes in the rotary bearing which are adapted for receiving the pin. Alternatively, the pin can be disposed on the rotary bearing, and the table or stationary portion has one or more holes which are adapted for receiving the pin. The rotary bearing may include a handle so that a user can rotate the bearing by grasping the handle and rotating. Other ways in which a user can more easily rotate the rotary bearing include a rotary or linear gear that meshes with the rotary bearing, so that the rotary bearing turns when the gear is moved.

The present apparatus can include a pivot connected to the umbrella pole. The pivot can be a ball pivot, a cylinder (such as a screw or bolt) through the umbrella pole, or a trunnion which may be modified. For example, the umbrella pole can include two cylindrical protrusions which are mounted in holes or indentations on the rotary bearing, or the rotary bearing can include two cylindrical protrusions mounted in holes or indentations on the umbrella pole. The pivot can be connected to or integral with the rotary bearing. The pivot can be at or near a surface such as a table top, or disposed in a housing. The pivot divides the umbrella pole (at least for purposes of angular motion and balance) into upper and lower pivoting sections. In embodiments of the present apparatus, the upper pivoting section of the umbrella pole can be greater than ⅔, alternatively greater than ¾, alternatively greater than ⅘, of the length of the umbrella pole. A longer upper pivoting section increases or improves the surface area being shaded, and provides a greater range of motion for the canopy.

In the preferred embodiments of the present apparatus and methods, a rotary bearing is connected to a table, and the spring(s) and the pivot are connected to the rotary bearing so that the umbrella pole is capable of rotation around its axis or an elliptical path. The rotary bearing can be mounted to the table top (either to the topside or the underside), and the pivot can be over or under or within the table top, and preferably the clamp or other connection between the spring(s) and the umbrella pole is below the pivot. Alternatively the rotary bearing can be integral with the table and/or can form part or all of the table top. Movement of the umbrella pole by the gas spring(s) pivots the umbrella pole near the hole in the table top. Alternatively, the rotary bearing can be disposed in a housing that rests on a table top or other surface. The rotary bearing can be integral with the housing.

Typical outdoor tables have holes in their centers which are adapted for an umbrella pole. In some embodiments, the hole in the table top has a diameter, and the umbrella pole has a diameter, and the table top hole diameter can be at least twice the size of the umbrella pole diameter. For example, the umbrella pole diameter may be about 1 inch, and the table top hole diameter may be about 3 inches. By providing a table top hole diameter that is larger than the umbrella pole diameter, the umbrella pole is allowed to tilt within the table top hole. Alternatively, the apparatus can be provided on top of a table, so that the umbrella pole does not tilt in the hole; in such embodiments, a conventional table top hole can easily be employed.

The apparatus can include one or more means for connecting various components to each other, such as means for connecting the spring(s) to the umbrella pole or means for connecting the springs(s) to the rotary bearing. For example, the apparatus can include a bracket that connects the gas spring(s) to the rotary bearing at a position lower than the pivot. As another example, the apparatus can include a clamp for holding the umbrella pole, where the clamp is connected to the spring(s). As another example, the apparatus can include a bracket having teeth or holes and a latch that engages the teeth or holes.

The present apparatus and methods may be understood by reference to the figures, though the present invention is not limited to the particular embodiments shown in the figures. In FIG. 1, an apparatus for holding and tilting an umbrella pole is disclosed and shown. An umbrella pole 10 is shown in a vertical orientation, and in this orientation, the umbrella pole forms a pole angle with the ground that is substantially 90 degrees or perpendicular to the ground. The apparatus includes two gas springs 12, only one of which is fully visible in FIG. 1. The gas springs are adapted to provide linear motion such that the piston rod 12*a* of the gas spring may extend or retract. The gas spring 12 also includes a cylinder 12*b* that contains gas and/or another fluid. The spring(s) can be substantially perpendicular to the umbrella pole. Alternatively, the spring(s) may be mounted angularly to the umbrella pole, to provide a variation of balance characteristics and function. Generally, the spring(s) are mounted so that they are not parallel to the umbrella pole, so that they can provide force to change or maintain the pole angle and/or provide counter balance while the pole angle is being adjusted. The gas spring is connected to a clamp 14, which in turn is connected to the umbrella pole 10. Thus, in FIG. 1, the spring(s) 12 are indirectly connected to the umbrella pole 10, though direct connection is also contemplated. A first end of the gas spring 12 (the piston rod 12*a*) is connected to the bracket 14 and a second end of the gas spring 12 is connected to a bracket 16. The bracket 16 in turn is connected to a rotary bearing 18.

Figure 2:
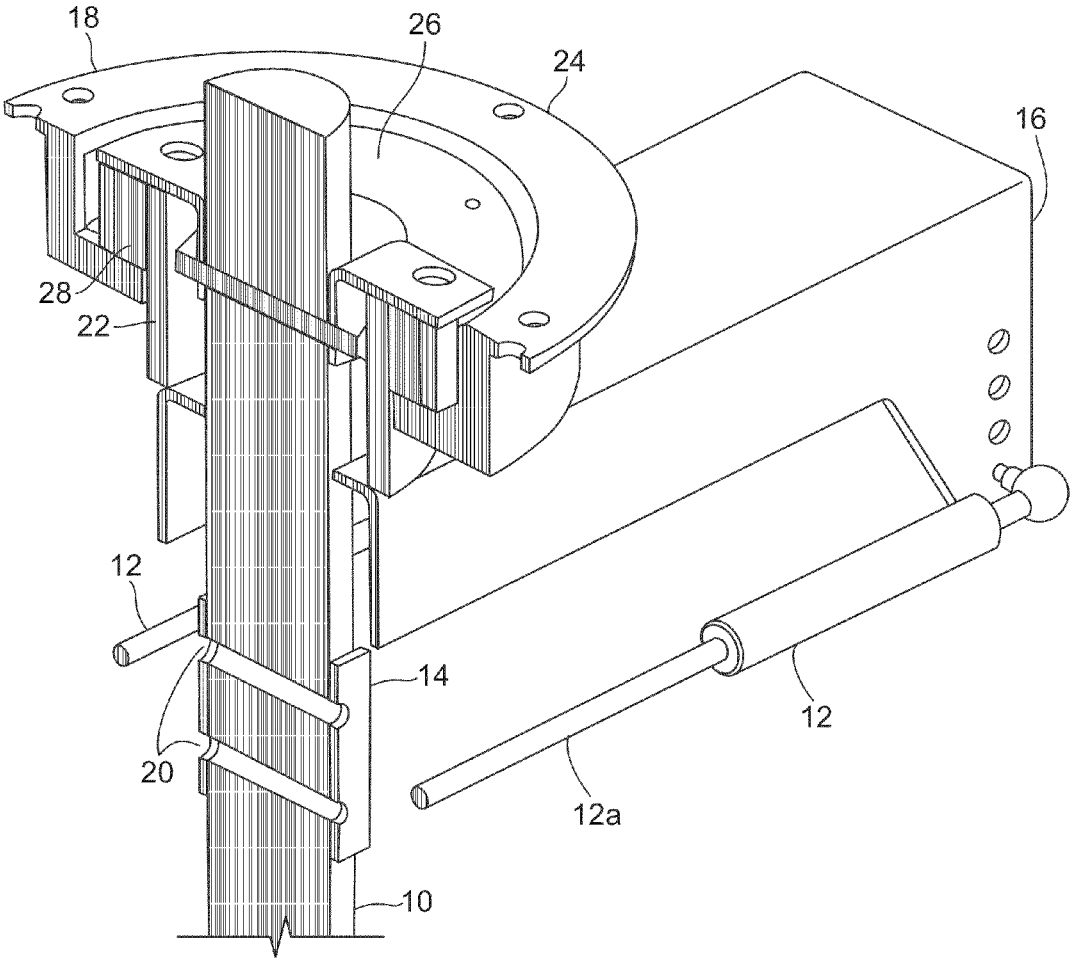
FIG. 2 shows a cut-away view of an apparatus for holding and tilting an umbrella.

FIG. 2 shows the same apparatus as in FIG. 1 in a cut-away view, with one-half of the apparatus cut away along the mid-section of the umbrella pole and the rotary bearing. In FIG. 2, the umbrella pole 10 and clamp 14 have holes or apertures 20 adapted for receiving a screw adapted for fastening the clamp 14 to the umbrella pole 10. Umbrella pole 10 has one or more other apertures 22 adapted for receiving a screw that will fasten the rotary bearing 18 or a portion thereof to the umbrella pole 10. In FIG. 2, a bracket is used to connect the rotary bearing 18 to the umbrella pole 10. In FIG. 2, the rotary bearing 18 comprises an outer housing 24 or ring adapted for attachment to the underside of a table, and an inner housing 26 or ring which is in rotational relation to the outer housing 24. The inner housing 26 in FIG. 2 is an annular ring adapted for rotation around a central axis of the rotary bearing 18, and the rotary bearing 18 also comprises a rolling element (such as roller bearings or ball bearings) 28 adapted for providing smooth rotation of the inner ring 26. When the gas springs 12 are extended, the clamp 14 and umbrella pole 10 move linearly, resulting in a change of the pole angle by the umbrella made with the ground. The end of the piston 12*a* of the gas spring 12 is attached to the clamp 14 by a pivot 30 (shown in FIG. 1) that allows the clamp to rotate. When the gas springs are retracted, the clamp and umbrella pole move linearly in the opposite direction from when the gas springs are extended. In other words, when the gas springs 12 are retracted, the umbrella pole moves back to a vertical position. In some embodiments, the gas springs may be adapted to retract beyond the vertical position, so as to change the pole angle so that the canopy will face the opposite direction. In other embodiments, it is not necessary for the piston of the gas spring(s) to fully retract. It may be preferable that the springs 12 are positioned to extend to a maximal degree without being able to retract from holding the umbrella pole in a vertical orientation, because virtually any desired pole angle can be achieved by extending the gas springs and rotating the umbrella pole so that the canopy is in a desired position.

The present apparatus can also include a linear actuator connected to one or more of the umbrella pole or the spring(s), so that the linear actuator provides actuated movement of the umbrella pole and adjustment of the pole angle. The linear actuator can be directly or indirectly connected to the umbrella pole, such as through a clamp that is directly connected to both the umbrella pole and the linear actuator. Suitable linear actuators include ballscrew actuators, lead-screw actuators, rack and pinion actuators, belt driven actuators, linear motor driven actuators, and others. The linear actuator can be hydraulic, pneumatic, electric, motorized, or other types. For example, the linear actuator can include a lead screw that is connected to the umbrella holder or a clamp where the lead screw is driven by a motor.

It is contemplated that the present apparatus and methods can be automated, and to that end, a controller can be connected to the linear actuator. The controller receives input and provides an output to the linear actuator that adjusts the pole angle of the umbrella.

A motor may be attached to the umbrella pole, or to the spring(s), or to a clamp, via screws, bolts, nails, soldering, rivets, adhesives, or other attachment means, including being integrally formed with the base. The motor can be any type of motor: combustion, electric, combustion/electric hybrid, brushless, servo, AC, DC, stepper, or gear motor.

The motor can be operatively connected to a controller so that the controller can be used to manually actuate movement of the umbrella. Alternatively the controller may be operatively connected to a linear actuator or motor wirelessly, so long as a control signal may be send by the controller to actuate the motor. Alternatively or additionally the controller can be programmed to cause the umbrella to automatically follow the movement of the sun or to adjust the umbrella at selected time intervals.

An umbrella can be inserted into the present apparatus for holding and tilting an umbrella, so as to provide an apparatus that provides adjustable protection from sun, rain, wind and/or other weather conditions. An umbrella typically includes a pole and a canopy, and may also include a frame that extends (or withdraws) the canopy as well as other components. Canopies can be water repellant or water permeable, and can be canvas, metal, plastic, or another material that provides some protection from the sun, wind, rain or other weather conditions. The umbrella (particularly the canopy) can be shaped like a dome, a cone, or any other suitable shape. The term umbrella is intended to include anything that provides protection from one or more weather conditions and is not limited to any particular shape or material.

The umbrella can be directed toward the sun to maximize shade against the sun provided by the umbrella. However, the user can easily adjust the umbrella or decrease the shade or protection provided by the umbrella. The user can easily change the pole angle of the umbrella (the angle defined by the umbrella pole and a surface such as the ground or table top). When the umbrella is in use, the umbrella pole and the ground can be considered as defining a pole angle. Alternatively, when the umbrella is used with an outdoor table, the pole angle may be defined by the umbrella pole and the table top. Even where the ground is not precisely flat, the user will have a sense of the degree of tilt of the umbrella, especially vis-à-vis the sun, rain, wind, or other weather conditions. In general, a change in the pole angle of an umbrella can be readily detected by the user.

Other methods and means for providing linear and/or rotational movement to an umbrella pole are also contemplated. For example, the umbrella pole can be adjusted by use of rack and pinion, worm gear, barrel cam, Geneva mechanism, or any other form of geared motion, by arranging them to provide linear motion to a bottom portion of the umbrella pole, thereby adjusting the pole angle. As other examples, the means for moving the umbrella could comprise one or more cylinders configured to provide linear or rotational motion of the umbrella (such as pneumatic, hydraulic, electric).

Figure 3:
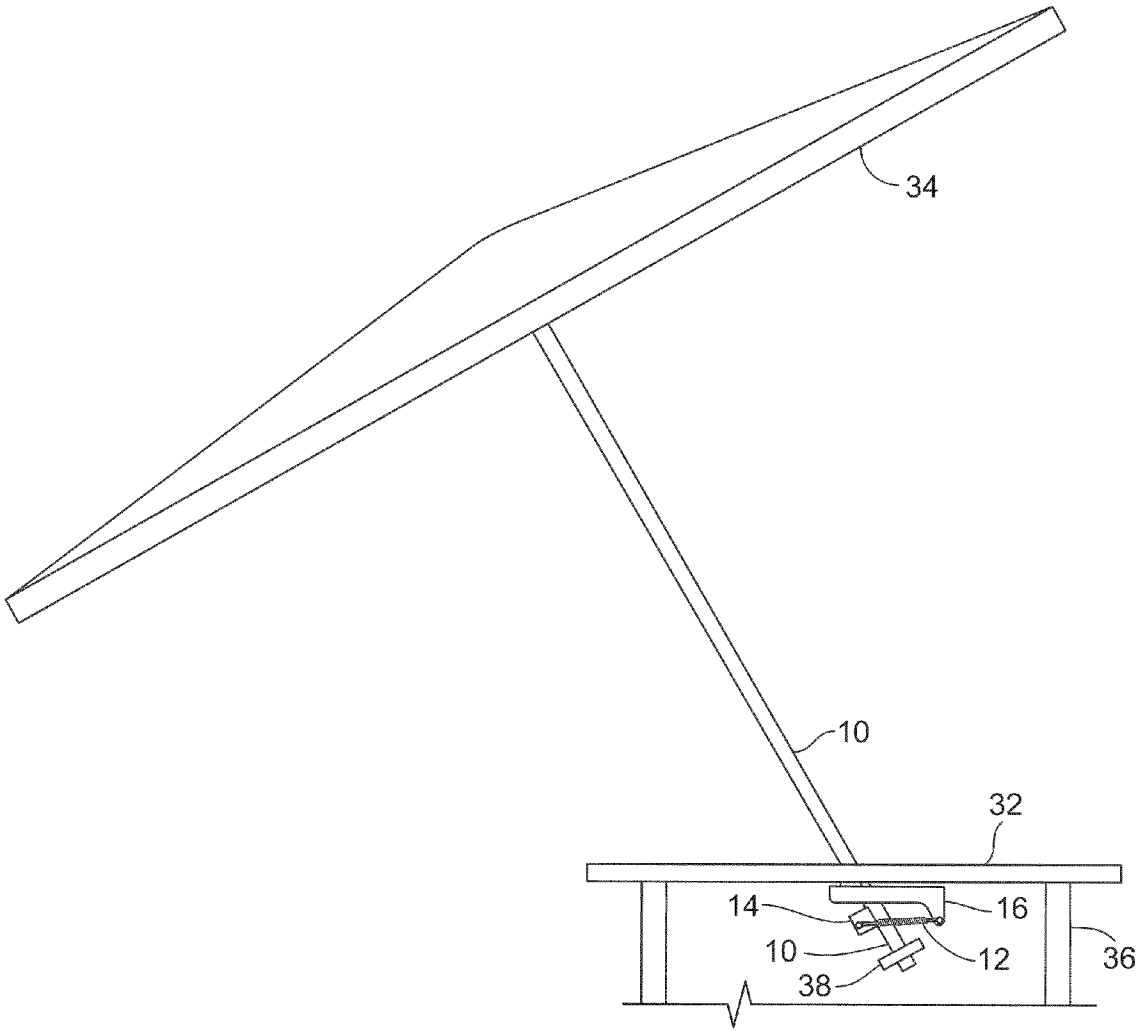
FIG. 3 shows an apparatus providing protection from sun or other weather conditions, which includes a shade umbrella and an apparatus for holding and tilting the umbrella so that it provides shade over an outdoor table.

FIG. 3 shows a configuration of the present apparatus for providing protection from the sun, rain, wind or other weather conditions. FIG. 3 shows an apparatus for holding and tilting an umbrella that provides shade over an outdoor table. The umbrella has an umbrella pole 10 and a canopy 34. The table top 32 has a hole for receiving the umbrella pole and one or more legs 36 for supporting the table top 32. Alternatively or additionally, the table top can have a central support or post extending from the table to the ground, and that post can also be connected to the apparatus. The apparatus comprises at least one gas spring 12 connected to the umbrella pole 10 so that the umbrella pole 10 moves when the gas spring(s) 12 extends or retracts. The apparatus also comprises a pivot that engages the umbrella pole at or near the table top. A counterweight 38 is connected to and suspended by the umbrella pole 10. The umbrella pole pivots when an end of the umbrella pole moves, and this changes a pole angle formed by the umbrella pole and a surface, such as the table top or ground. A user can change the pole angle of the umbrella by grasping the pole and pulling or pushing it, and the springs operate to move the umbrella pole from a first position to a second position. The pivot and the gas spring(s) can be connected directly or indirectly to the table. The springs can serve as a means for moving the umbrella and are operatively connected to the umbrella pole, either directly or by using a clamp 14, a tube for holding the umbrella pole, or another holder as an intermediary.

FIG. 3 shows the present apparatus holding and tilting a shade umbrella. As shown, the umbrella pole defines a pole angle with the table top 32 of about 60 degrees, though the apparatus may provide any desired pole angle or range of pole angles, such as from about 10 degrees to about 90 degrees, or from any of about 20, about 30, about 45, about 50, or about 60 degrees, to about 90 degrees. In FIG. 3, the gas spring(s) 12 (more particularly the pistons of the gas springs) are retracted to move the clamp 14 and a bottom portion of the umbrella pole 10 from a first position to a second position.

The canopy is tilted toward the left in FIG. 3. If a user desired to have the canopy tilted toward the right, he could use the rotary bearing to rotate the umbrella by one-half rotation, or he could pull or push the umbrella pole 10 to extend the gas spring and move the clamp and umbrella pole linearly. In general, the canopy can be placed in any desired position by a combination of moving the umbrella pole to a desired pole angle and rotating the umbrella to a desired rotation.

The present apparatus can also include a flexible covering between the table top and the umbrella pole that covers the table top hole while permitting movement of the umbrella pole. The flexible covering can be a bellows that has folds, so that the covering can move along with the umbrella pole. The flexible covering can be connected to the rotary bearing so that it also rotates, or it can be connected to a table top, so the umbrella pole rotates inside a hole in the top of the flexible covering.

Figure 4:
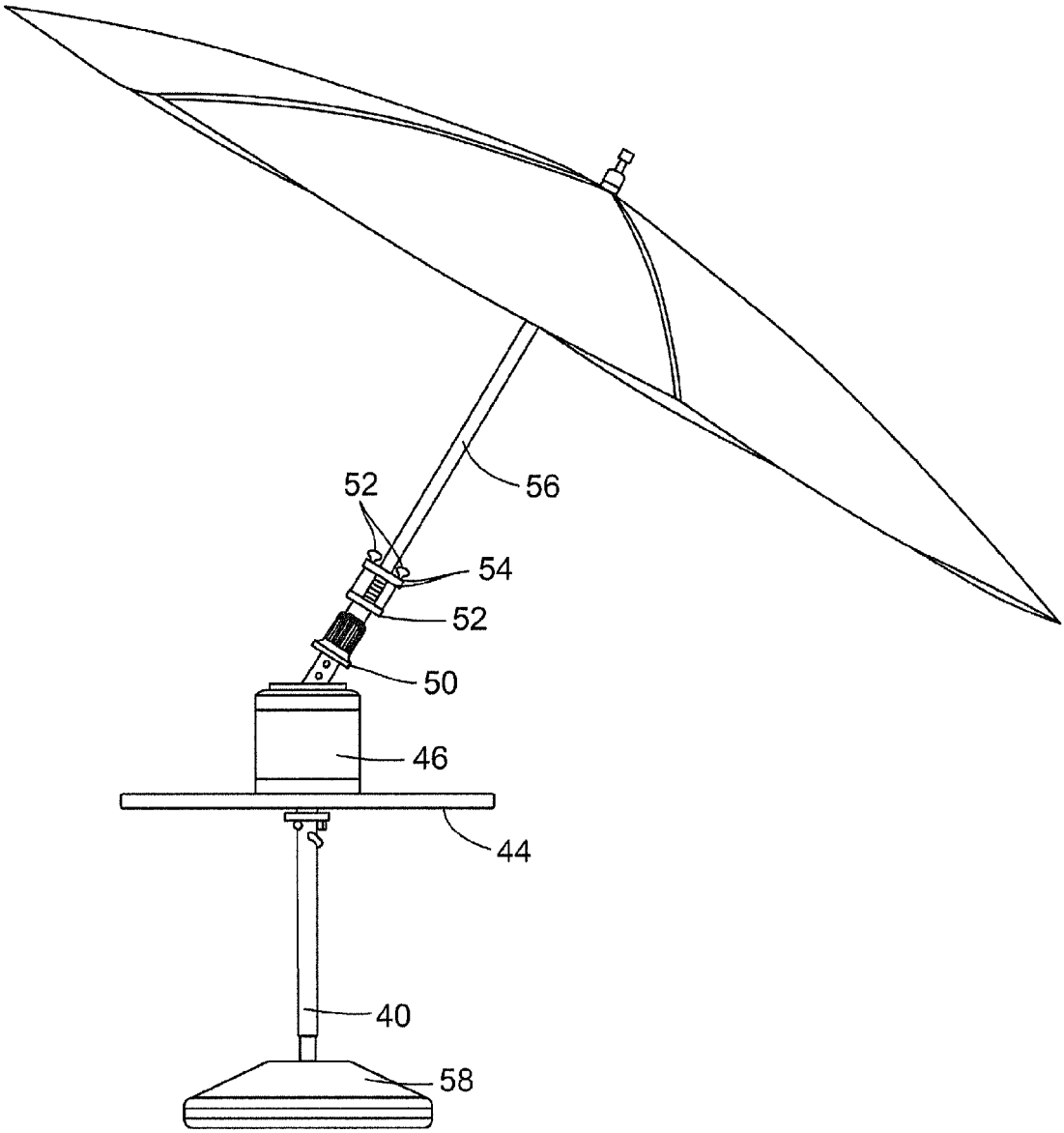
FIG. 4 shows another apparatus providing protection from sun or other weather conditions, which includes a housing for mechanisms that hold and tilt an umbrella.

FIG. 4 shows another embodiment of the present apparatus for holding and tilting an umbrella. In FIG. 4, the apparatus comprises a housing that encloses an alternative arrangement of components for holding and tilting an umbrella (shown in more detail in FIG. 5), including one or more of a bracket, latch, springs and/or other components. FIG. 4 shows the housing disposed on top of a table or another surface, though it is also contemplated that the housing can be located below a table top or other surface. In FIG. 4, an umbrella is held at an angle over a patio table by an apparatus that includes a tilting mechanism in a housing 46. A post 40 is disposed between the housing 46 and an umbrella base 58. The use of an umbrella base with the present apparatus may be desirable for enhanced stability, though it is contemplated that smaller umbrellas (for example, umbrella of 6 feet or less) may be employed without the base. Post 40 fits into a standard umbrella base 58 for additional support for the umbrella and the apparatus. The diameter of the post 40 is about the same as that of a conventional umbrella pole, so that it can fit within the hole of a conventional outdoor table (typically about 1.75 inches in diameter). A flange at the top of this post 40 can fit inside of the housing or be attached to a bottom surface of the housing 46 (when present).

Figure 5:
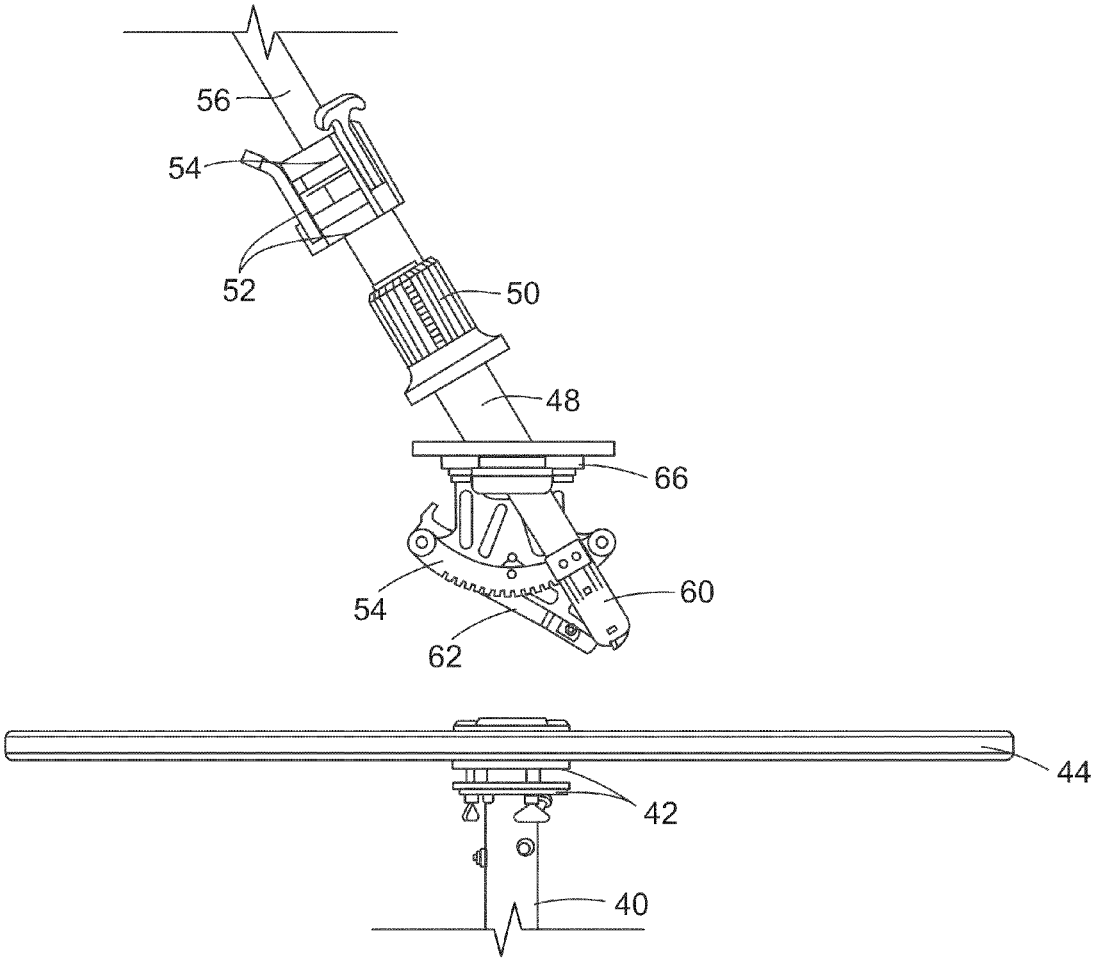
FIG. 5 shows another apparatus for holding and tilting an umbrella.

FIG. 5 shows the tilting mechanism inside the housing, providing a view of components within the housing that are operable for altering and maintaining a pole angle of the umbrella. The apparatus may provide any desired pole angle or range of pole angles, such as those pole angles set forth above.

Although the present embodiment is described with reference to a table top, it is not limited to use with table tops, but rather may be employed with other surfaces. For example, a small plate may be employed in place of the table top, such that the small plate connects the housing 46 to the post 40. In this embodiment, a mechanism 42 having first and second rings is provided to attach post 40 to outer housing 46, though as mentioned above, the post 40 can be attached directly to the housing 46. The first ring is underneath the table top 44. The second ring is compressing the flange inside the housing by using thumbscrews to compress the first ring to the flange.

The present apparatus comprises a tilting/rotating mechanism within the housing 46. The housing 46 can be fashioned from any suitable material, such as polyvinyl chloride, aluminum, stainless steel, and other materials. Grooves can be provided on the top and bottom of the housing to allow the insertion of a menu or advertising. Bands or adhesives can be used to more securely attach the menu or advertising to the housing. The housing can be compact, preferably less than 18 inches in height, alternatively less than 12 inches in height.

The apparatus includes a hollow tube 48 as a holder for an umbrella pole. This tube 48 is capable of rotation and tilting and therefore rotates and tilts the umbrella. Alternatively the tube 48 can be replaced by a post that is inserted into a hollow umbrella pole, or by another holder for the umbrella pole. The apparatus includes a handle 50 disposed on the tube 48 which can be used to control a set of lever arms that operate one or more latches 60. When pushed down, the lever arms are released and will allow the tube 48 and therefore the umbrella 56 to be tilted. The apparatus also includes a bias such as a spring return (to force the handle up when not pushed down by a user), so that the handle 50 causes the latch 60 to be engaged and maintain the umbrella pole at the desired pole angle. Alternate handle designs can be employed, or a button, crank or other mechanism can be provided to control the latch 60. The bias can be connected to the handle so as to bias the handle in a direction where the latch is engaged with the bracket. The bias can be located inside or outside the holder.

This embodiment shown in FIGS. 4 and 5 also includes an arrangement for securely holding the umbrella within the holder. One or more straps 52 are located on the tube 48, and the umbrella includes a ring 54 having one or more pins, such as posts or pins. The term strap includes loops, hooks, clamps, or other devices that can extend or stretch over a pin, and the term pin includes posts, hooks and other protrusions. When the umbrella 56 is inserted in the tube 48, the straps are placed over the pins on a ring 54 affixed to the umbrella 56. This holds the umbrella inside the tube 48. One or more bushings can be used with this ring 54 to accommodate different size umbrellas. The umbrella will be held in place at the top of the tube 48 of the apparatus. Instead of using a pin or a clamping collar, a 3 pin collar (attached to the umbrella) can be used. A strap located on the tube of the device will latch around the pin. The present embodiment can be used with specially made umbrellas which have a shorter pole length and a ring 54 disposed thereon, or a standard umbrella can be modified by attaching a ring 54 and by reducing its pole length.

The present apparatus includes one or more latches 60 at an end of the tube 48. The latch 60 can be used in conjunction with a bracket 64 and one or more gas springs 62 to control the angle of tilt. The term latch includes pins, teeth, hooks or other devices that can catch, hold or engage another structure, such as the bracket 64. The bracket 64 extends down from the rotary bearing 66. The curved bracket 64 has a gear profile, which can interlock with latch 60 to lock the umbrella into a desired angle. The bracket 64 can be provided with locking teeth to provide a sprocket or gear, and the latch can have one or more pins (the term pins includes posts or other protrusions) that engage the teeth. Alternately the bracket can be a plate with a plurality of holes in a radial pattern oriented about the axis of rotation, and the latch can include protrusions that engage the bracket by insertion into the holes. Preferably the bracket and latch are adapted for releasably engaging each other and have one or more interlocking and/or reciprocal elements. The rotary bearing 66 allows the umbrella to be rotated over 360 degrees. The present apparatus can include one or more magnets disposed around the rotary bearing and adapted to engage the rotary bearing, so as to lock the rotary bearing in place.

Figure 6:
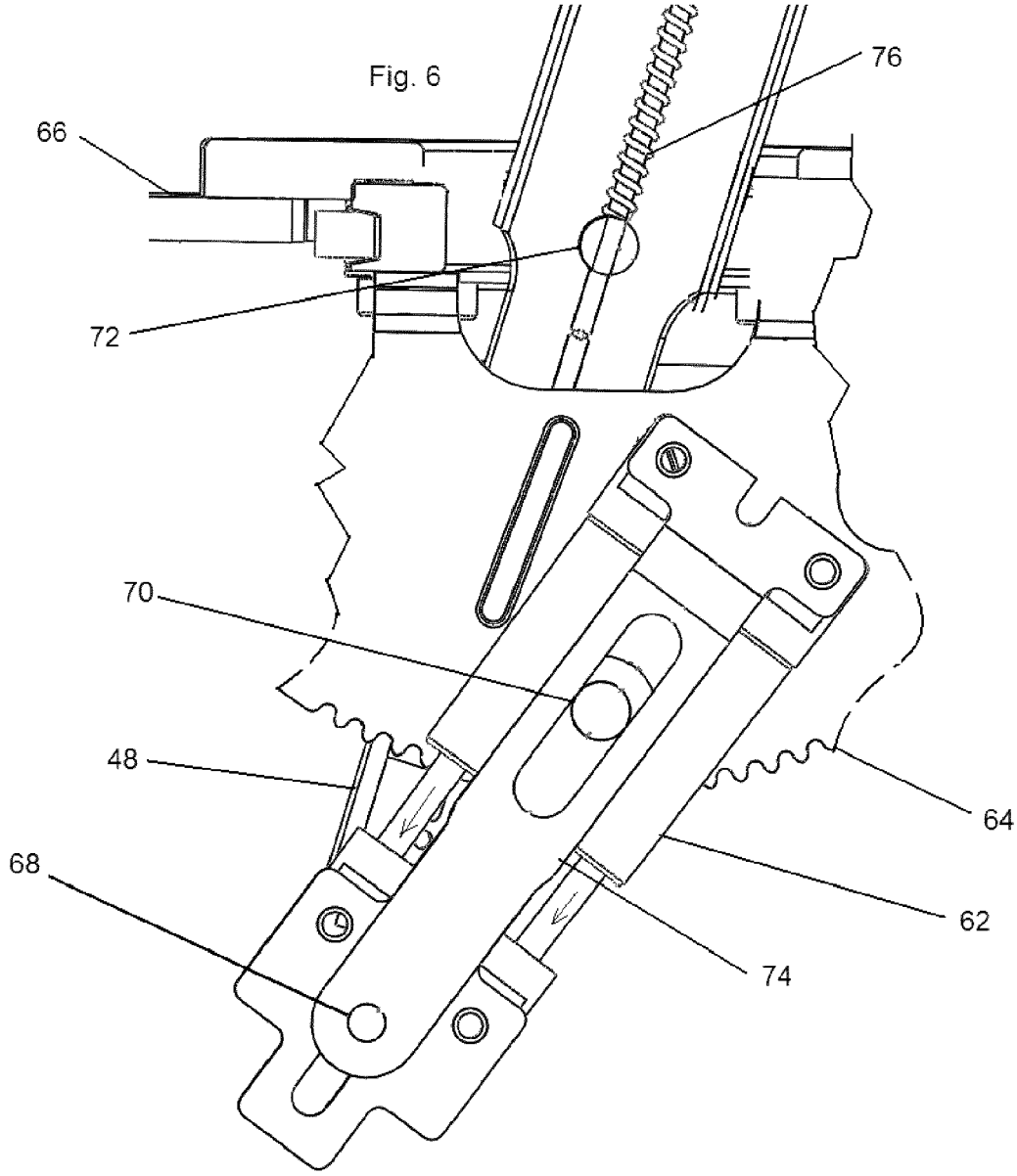
FIG. 6 shows a closer view of the apparatus of FIG. 5.

FIG. 6 shows a closer view of how the gas springs can be connected to the bracket 64 and umbrella holder 48 so as to provide a counter-balance to the moment created by the tilting umbrella. The gas springs 62 can be indirectly connected to the holder 48 and the bracket 64 by virtue of being disposed in a gas spring cartridge 74, with the cartridge 74 being actually attached to the tube 48 and bracket 64. The springs and/or the cartridge can be pivotably attached to the bracket 64 or the holder 48. The gas spring cartridge 74 preferable coordinates operation of two or more gas springs and can be pivotably attached to a bracket and an umbrella holder. In FIG. 6, the umbrella tube connection 68 to the gas spring cartridge 74 includes a pivot, and the cartridge 74 is also attached to the bracket by a pivot 70. When the umbrella pole is vertical, the gas springs are also vertical and are extended. As the umbrella pole is tilted, the gas springs are compressed. The further the umbrella tips, the higher counter-balancing force is required. The present apparatus appropriately balances the moment or torque regardless of the angle, since a greater counter-moment is provided as the distance or angle between the holder 48 and the gas springs 62 is increased. FIG. 6 also shows a pivot 72 for the tube 48, which is disposed above the pivot 70 for the gas spring cartridge. Preferably, pivot 72 and pivot 70 are vertically aligned. In some embodiments, the apparatus has a first pivot between the umbrella holder and a rotary bearing, a second pivot between the umbrella holder and one or more springs, and a third pivot between the springs and a bracket. A spring bias 76 for urging a latch to engage the bracket 64 is also shown. The spring bias 76 is connected to the handle 50.

The springs 62 used in the present apparatus can be heavily dampened. Springs are available that have an integral lock that will hold position within a small range of travel. The springs can be self-locking springs that have some compliance, allowing +/−10% movement from the locked position. This arrangement provides the ability to provide a counterbalance to the moment created by tilting the upper portion of the umbrella.

An advantage of the present embodiment is its convenience for use above the table, making it easy to retrofit existing outdoor furniture and making it possible for use with the standard hole of many available patio tables. Many tables have a hole measuring 1.75 inches, and the present apparatus can easily be used with such tables. Other advantages are that the axis of rotation can be oriented about the center of mass of the user (instead of above) which improves performance and function of an umbrella. This embodiment also allows for balancing the forces of the moment created by an umbrella that is not vertical. It is done in such a fashion that the balancing forces are always approximately equal and opposite. This embodiment allows for counterbalance to be added, such as by adding weight to the tube or the bottom of the umbrella pole. The present embodiment also provides significantly more angular adjustment positions, and the use of a bracket having a plurality of teeth can provide many positions. Alternatively the overall angular range for the umbrella pole can be readily limited based on site conditions (15 degs vs. standard 30). Another advantage is that the handle for controlling the apparatus is in a position more favorable for operation, in that the operator can remain in a seated position to operate it, and in most cases handicap accessibility is improved.

The present apparatus can include mutually independent locking means, in that separate locks can be provided for rotation and tilting. A mechanical lock or magnets can prevent or reduce rotation by engaging the rotary bearing, and the latch and bracket engagement and/or self-locking springs can prevent or reduce changes to tilt or the pole angle.

The use of gas springs provides a safety advantage for the various embodiments of the present apparatus. Integral valves or porting in the gas spring provide velocity control during adjustment. There is less chance of injuring occupants under canopy or umbrella, and it slows reaction if a wind gust during adjustment.

The present apparatus described above is useful as an adjustable umbrella apparatus. An adjustable umbrella apparatus that includes the springs may be useful due to its tiltability and tip-resistance. A user may adjust the pole angle and move the canopy in a western direction, causing the springs to extend. Correspondingly, the user may adjust the pole angle and move the canopy in an eastern direction, causing the springs to retract and maintain the eastern tilt and desired pole angle of the umbrella.

An additional advantage of the present disclosure is that it also provides an apparatus for holding an umbrella which is resistant to tipping although it should be recognized that this advantage need not necessarily be present in every embodiment of the disclosure. As an example, the apparatus shown in FIG. 3 is resistant to tipping by winds having speeds of at least about 20 miles per hour (mph). Preferably, the umbrella does not tip in winds of at least about 30 mph and/or when the umbrella is fully opened at an angle of about 45 degrees relative to the ground or table top. A tip-resistant umbrella apparatus is especially desirable for use in environments having potential for high winds, such as rooftop decks, beaches, cruise ships, and other locales. When tip-resistance is particularly desirable, the apparatus can be provided with at least about 10 pounds of weight, alternatively at least about 25 pounds of weight, alternatively from 10 to 25 pounds of weight. The weight may be the weight of the table and/or the weight of a counterweight. Alternatively or additionally, the table can have a central support or post extending from the table to the ground, which provides additional weight and stability, and that post can also be connected to the apparatus. The wind speeds, umbrella tilt angles and ballast weights disclosed herein are provided for mere context and as exemplary embodiments and are not to be interpreted as limitations on the disclosure.

Automated motion of the umbrella can be controlled by manually actuating a controller, as described above, or by some other means. Alternatively, the automated motion of the umbrella can be automatically controlled, such as by a computer or programmable logic controller. An apparatus can include a controller that provides both manual and automatic actuation at the option of the user. The automated motion of the umbrella can be controlled so as to track the sun, and the apparatus can include a timer or a sun-tracking means for this function. The automated motion may be controlled by a computer which instructs the motor in accordance with data stored in a memory; alternately the motor may be coupled to an adjustable timer or sun-tracking means. The hydraulic, mechanical or electronic components of a sun-tracking means may include sun sensors and/or appropriate circuits for the control and coordination of the various movements.

The sun-tracking means may be operatively connected with the springs or rotary bearing for moving the umbrella. The sun-tracking means can be configured to continuously align the umbrella with the sun as it moves across the sky during all or a portion of the day. The sun-tracking means may include mechanical, hydraulic, electric and electronic components which are well-known and commercially available.

For example, assembled systems for tracking the sun have been described in the art. Some systems use photo-responsive electrical devices and electrical circuitry connected thereto which determine the direction of sun movement relative to the photo-responsive devices and continually, via the electronic or electrical circuitry, realigning the system so that the sun was always at the center of the photo-responsive device. Systems for providing automated movement, or a signal triggering automated movement, based on a predetermined interval, are also known. The present apparatus may include a system for tracking the sun from east to west with automatic adjustments being made on a minute-by-minute or other basis.

The present apparatus for automated movement of an umbrella can also include means for physically moving the umbrella without the use of a motor or other means. A hand crank instead of a linear actuator or motor or other means could be used to move or rotate the umbrella.

With regard to means for controlling the automated movement of the umbrella, any of a variety of user interfaces may be employed. A controller with push buttons can be provided, but other interfaces may be used as well. For example, one or more dials, switches, or knobs can be provided, or a touch-screen can be provided for controls. Moreover, the controller can be part of a network or otherwise controlled by a computerized system.

When the apparatus is to be manually actuated, it can be manually actuated through one or more push buttons, dials or other controls to be adjusted by a user. Alternatively or additionally, the apparatus can be actuated through a remote control, and a controller for the apparatus can include a remote control. For example, the spring(s) and/or rotary bearing may be controlled by a remote control. The remote control may operate by radio frequency waves or by electric signals sent through a conductive line. Other remote controls are possible. For example, systems based on or similar to those used in garage door openers can be employed. The control system can send a signal to drive a linear actuator or motor and hence the umbrella in one direction and another signal to drive the linear actuator or motor in another direction. In some embodiments, a central control can be adapted for sending signals to a plurality of remotely located apparatus for a plurality of umbrellas, such as may be found in a sidewalk café. Various methods of actuating the spring(s) or rotary bearing are possible without varying from the spirit of the present disclosure.

The present disclosure also relates to methods for automated movement of an umbrella. The methods can comprise continually moving an umbrella, such as to follow the path of the sun or to change the angle of the umbrella pole relative to the ground. Alternatively, the methods can comprise moving an umbrella at predetermined intervals, such as approximately every five minutes (or approximately every 1 minute, 2 minutes, 10 minutes, or another interval).

In the present specification, use of the singular includes the plural except where specifically indicated. In the present specification, any of the functions recited herein may be performed by one or more means for performing such functions.

All patents cited herein are fully incorporated by reference to the extent such disclosure is not inconsistent with this apparatus and for all jurisdictions in which such incorporation is permitted.

While the presently disclosed apparatus has been described and illustrated by reference to particular embodiments, it will be appreciated by those of ordinary skill in the art that the invention lends itself to many different variations not illustrated herein. Accordingly, the scope of the present invention is not limited to any particular embodiment but rather is defined by the appended claims.

Although the dependent claims have single dependencies in accordance with U.S. patent practice, each of the features in any of the dependent claims can be combined with each of the features of other dependent claims or the main claim.

The invention claimed is:

1. An apparatus that holds and tilts a shade umbrella having an umbrella pole and a canopy, wherein the umbrella pole defines a pole angle with a surface below the canopy, the apparatus comprising:

a shade umbrella having an umbrella pole and a canopy;

at least one gas spring connected to the umbrella pole and to a bracket, so that operation of the gas spring moves the umbrella pole from a first position to a second position and the umbrella pole is maintained in the second position; wherein the umbrella pole has different pole angles when in the second position compared to the first position;

a pivot for the umbrella pole that allows angular motion of the umbrella pole; and a rotary bearing connected to the bracket for rotating the umbrella pole around an axis of the umbrella pole;

wherein the gas spring and the pivot are rotated by operation of the rotary bearing.

2. The apparatus of claim 1 wherein the apparatus comprises one or more locks or latches for maintaining extension or retraction of the at least one gas spring.

3. The apparatus of claim 1, wherein the bracket is disposed between the spring and the rotary bearing.

4. The apparatus of claim 3, wherein the apparatus further comprises a housing that surrounds the spring and the bracket.

5. The apparatus of claim 3, further comprising a holder for the umbrella pole and a handle connected to the holder, wherein operation of the handle disengages the umbrella pole from the bracket.

6. The apparatus of claim 1, wherein the apparatus comprises two or more of the springs.

7. An apparatus for holding and tilting a shade umbrella providing shade over an outdoor table, wherein the shade umbrella comprises an umbrella pole and a canopy at a top end of the umbrella pole, the apparatus comprising:

an outdoor table having a table top;

a housing disposed on the table top;

a holder for receiving an umbrella pole;

at least one spring for connecting the umbrella pole so that the umbrella pole moves when the spring extends or retracts;

a pivot for engaging the umbrella pole at or near the table top, so that the umbrella pole pivots when an end of the umbrella pole moves, thereby changing a pole angle formed by the umbrella pole and the table top or ground;

a rotary bearing mounted on the housing for rotating the umbrella pole, and the pivot is connected with or integral to the rotary bearing.

8. The apparatus of claim 7 wherein the spring is a gas spring.

9. The apparatus of claim 7, further comprising a bracket attached to the rotary bearing that connects the spring to the rotary bearing.

10. The apparatus of claim 7, wherein the pivot divides the umbrella pole into upper and lower pivoting sections, and the upper pivoting section of the umbrella pole is greater than ⅔ of the length of the umbrella pole.

11. The apparatus of claim 7, further comprising a latch and a handle that are integral with the holder, wherein the holder is connected to the springs.

12. An apparatus for holding and tilting a shade umbrella having an umbrella pole and a canopy, wherein the umbrella pole defines a pole angle with a surface below the canopy, the apparatus comprising:

a holder for receiving an umbrella pole;

a latch connected to the holder;

a handle connected to the latch, so that operation of the handle releases or engages the latch;

a rotary bearing capable of rotating the umbrella pole around an axis of the umbrella pole;

a bracket connected to the rotary bearing, wherein the latch engages the bracket on operation of the handle; and at least one spring connected to the holder and the bracket, wherein the spring has at least first and second positions, wherein the umbrella pole has different pole angles when in the second position compared to the first position, and the engagement of the latch and the bracket maintains the umbrella pole at a selected pole angle.

13. The apparatus of claim 12, further comprising one or more of a lock, pin, magnets, or fastener adapted to prevent rotation of the rotary bearing when the lock, pin or fastener is used.

14. The apparatus of claim 12, wherein the bracket has teeth, and the latch is configured and positioned to engage the teeth of the bracket.

15. The apparatus of claim 12, further comprising a housing that surrounds the bracket, the latch and the springs.

16. The apparatus of claim 12, further comprising one or more straps connected to the holder, wherein the straps are adapted to fit over pins on an umbrella pole.

17. The apparatus of claim 12, further comprising a bias connected to the handle so as to bias the handle in a direction where the latch is engaged with the bracket.

18. The apparatus of claim 12, further comprising a shade umbrella being received the holder.

* * * * *